US010688681B2

(12) United States Patent
Alldred et al.

(10) Patent No.: US 10,688,681 B2
(45) **Date of Patent: *Jun. 23, 2020**

(54) FLAME-TREATED DRUM AND METHOD OF TREATMENT

(71) Applicant: D'Addario & Company, Inc., Farmingdale, NY (US)

(72) Inventors: Ben Alldred, Gateshead (GB); Bryan Kelly, Bay Shore, NY (US); Jason Talas, East Bernard, TX (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/137,826

(22) Filed: Sep. 21, 2018

(65) Prior Publication Data

US 2019/0022890 A1 Jan. 24, 2019

Related U.S. Application Data

(63) Continuation-in-part of application No. 15/620,281, filed on Jun. 12, 2017, now Pat. No. 10,210,850.

(60) Provisional application No. 62/561,715, filed on Sep. 22, 2017, provisional application No. 62/348,308, filed on Jun. 10, 2016.

(51) Int. Cl.
*G10D 13/08* (2020.01)
*B27K 5/00* (2006.01)
*G10D 13/02* (2020.01)

(52) U.S. Cl.
CPC ..... *B27K 5/001* (2013.01); *B27K 5/0085* (2013.01); *G10D 13/028* (2013.01)

(58) Field of Classification Search
CPC ..... B27K 5/001; B27K 5/0085; G10D 13/028
See application file for complete search history.

(56) References Cited

U.S. PATENT DOCUMENTS

| | | | | |
|---|---|---|---|---|
| 2,296,316 | A | 9/1942 | Stamm | |
| 6,326,535 | B1 | 12/2001 | Pokallus | |
| 10,210,850 | B2 * | 2/2019 | Kelly | G10D 13/003 |

* cited by examiner

*Primary Examiner* — Kimberly R Lockett
(74) *Attorney, Agent, or Firm* — Alix, Yale & Ristas, LLP

(57) ABSTRACT

A wooden drum shell that is treated by direct heating by exposure to a flame to alter the state of fibers in an outer layer of the drum shell relative to the untreated drum shell or inner fibers below the outermost layer. A method of manufacturing a treated drum shell includes selecting a wooden starting material, forming an untreated drum shell from the starting material, and exposing the drum untreated drum shell directly to a flame.

20 Claims, 5 Drawing Sheets

FLAME-TREATED DRUM AND METHOD OF TREATMENT

CROSS-REFERENCE TO RELATED APPLICATIONS

This application claims priority to U.S. Provisional Patent Application No. 62/561,715, filed on Sep. 22, 2017, and is a continuation-in-part of U.S. patent application Ser. No. 15/620,281, filed on Jun. 12, 2017, which claims priority to U.S. Provisional Patent Application No. 62/348,308, filed on Jun. 10, 2016, the entire contents of which are hereby incorporated by reference.

BACKGROUND

This disclosure relates to a drum made of wood, and in particular a drum made of wood that is treated by direct contact with an open flame.

The outer shell of many drums is made of a hard wood, such as oak, hickory, or maple, optionally with a lacquer or other sealant or finish. It is known that the removal of at least some moisture from wood assists strengthening and reducing or preventing damage or deformation over time due to increasing hardness. This initial trying step can be performed via indirect heating in a kiln, for example. However, the conventional drying process does not alter the fibrous makeup of the outer surface of the drum cylinder shell; it simply removes moisture present in the native wood materials.

A similar inventive technique is disclosed and claimed in co-owned U.S. patent application Ser. No. 15/620,281, which focuses on direct flame-treatment of the outer surfaces of wooden drumsticks—as opposed to drum cylinders—to alter the fibrous makeup of the outer surface of the wood, thereby forming a hardened outer layer on the drumsticks. The general concepts for altering the fibrous makeup of an outer layer of wood via direct flame treatment disclosed in U.S. patent application Ser. No. 15/620,281 are expressly incorporated herein by reference.

SUMMARY

It would be useful to provide an improvement to conventional wooden drums and the process by which they are manufactured which alters the fibrous makeup of an exterior surface of a drum by directly heating the outer layer of a drum cylinder with flame treatment.

In one embodiment, a drum shell with a wooden exterior surface is rotated past a stationary flame barrier resulting in a "charred" outer layer of wood with an altered fibrous makeup. In one preferred embodiment, the alteration of fibrous makeup can be caused by crystallization of tree sap resin that remains in the wooden outer surface.

The alteration of a wooden outer layer is known to result in a hard layer (or "exterior armor") on an item has been shown to inhibit denting, chipping and/or scratching of the outer wooden surface relative to untreated items of the same type of wood and configuration and/or relative to inner wooden fibers of the item that have not been exposed to flame. Direct flame treatment also alters the aesthetics of the outer surface of items, such as the disclosed drum shells, in a unique manner.

In another embodiment, a wooden drum shell with an outer layer is maintained in a stationary position while a flame source is moved over the outer layer to directly heat the outer layer with flame contact to alter the fibrous makeup of the outer layer.

In another preferred embodiment, the drum shell is made of oak and the exterior surface of the oak is flame-treated.

In a preferred embodiment, the outer wooden surface of the drum shell is directly exposed to a flame having a temperature within the approximate range of 2000 degrees F. to 4000 degrees F. to produce the treated drum shell.

BRIEF DESCRIPTION OF THE DRAWINGS

Aspects of the preferred embodiment will be described with reference to the drawings, wherein like numerals reflect like elements throughout.

DETAILED DESCRIPTION

Figure 1:
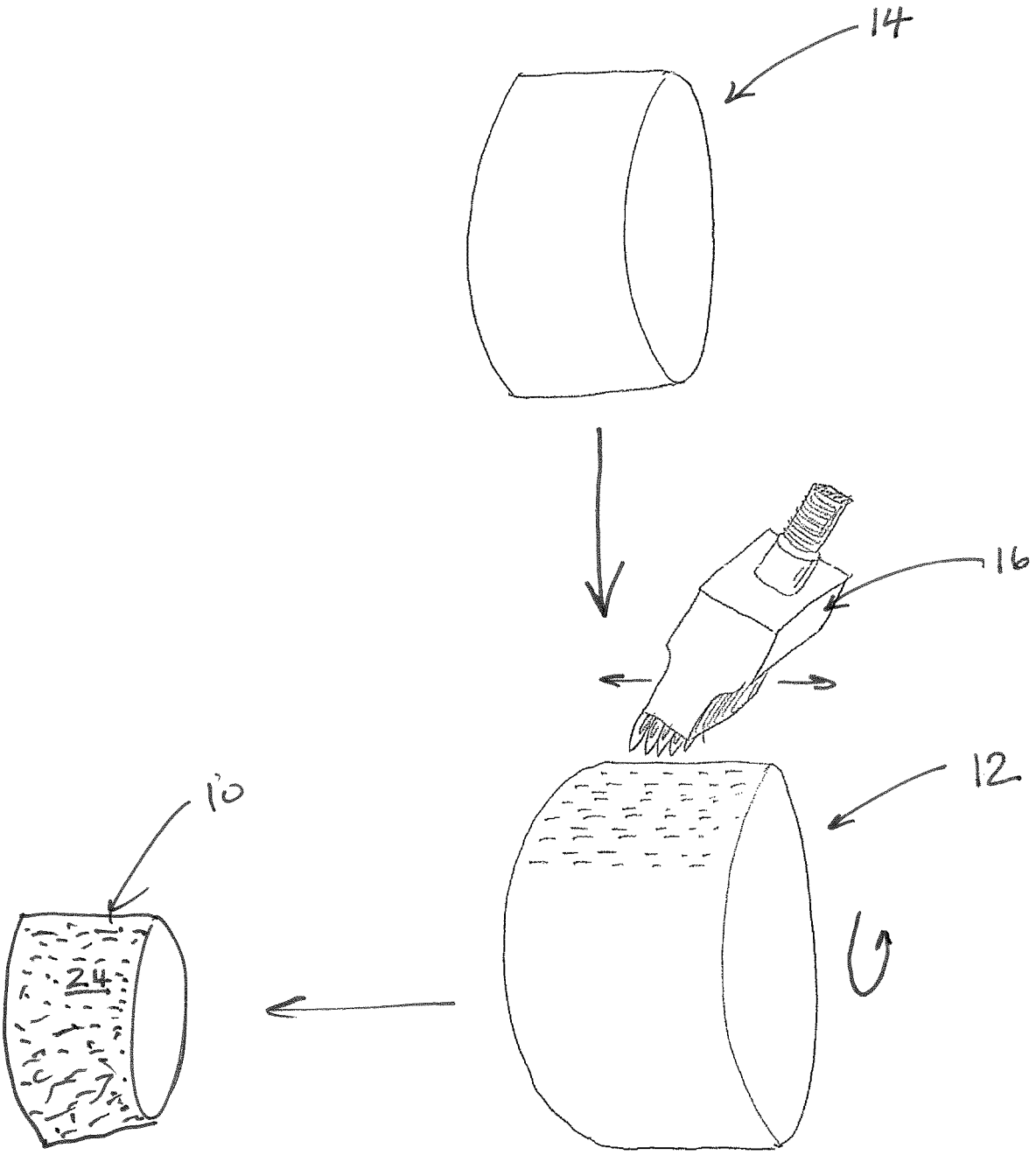
FIG. 1 shows a representation of a drum shell being flame-treated according to the disclosure.

Among the benefits and improvements disclosed herein, other objects and advantages of the disclosed embodiments will become apparent from the following wherein like numerals represent like parts throughout the several figures. Detailed embodiments of a flame-treated drum shell and a method of forming a flame-treated drum shell are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

As used herein, the meaning of the term "drum shell" is consistent with its generally understood meaning in the field of musical instrument technology. A drum shell often takes a substantially cylindrical shape extending longitudinally between an open top and bottom which can be fit with heads, with one head defining the playing surface. However, drum shells are not strictly limited to a cylindrical shape, and drums exist with an open bottom and only a top head for playing.

According to the present disclosure, an untreated drum shell 14 can be formed by any conventional known process or technique. The untreated drum shell is subsequently passed through either a single flame (16, 18 in FIGS. 1 and 2, respectively) or an array of flames (20, 22 in FIGS. 3 and 4 respectively) to form a flame-treated drum shell 10. The flames for use in the described process are typically produced from an ignitable gas mixed with oxygen or compressed air. The drum shell is treated evenly and completely by rotating the drum shell intermediary 12 while the flame and intermediary 12 are moved longitudinally relative to one another to allow the flame to directly treat the entirety of the outer surface to form the treated drum shell 10. Precise flame temperature and feed rate of the intermediary drum shell 12 (i.e., drum shell during flame treatment) are controlled to prevent under- or over-treatment of the end treated drum shell 10. The flame or array of flames may be produced with a single ribbon burner 16, fishtail configuration 18, multi-burner configuration (20, 22) or any similar configuration to provide contiguous temperature and flame contact with at least the outer surface of the intermediate drum shell 12 during the flame treatment step.

As noted above, direct flame treatment to alter the fibrous makeup of wooden outer layer is known to result in a hardened layer. This layer of "armor" provides numerous advantages relative to conventional untreated wooden surfaces, including increased surface strength, hardness and durability, as well as unique and attractive aesthetics. These altered properties are advantageous for inhibiting denting, chipping and/or scratching of the outer surface. Aspects of the flame treatment process can be altered to produce a treated drum shell 10 with different hardness properties as may be desired.

Figure 5:
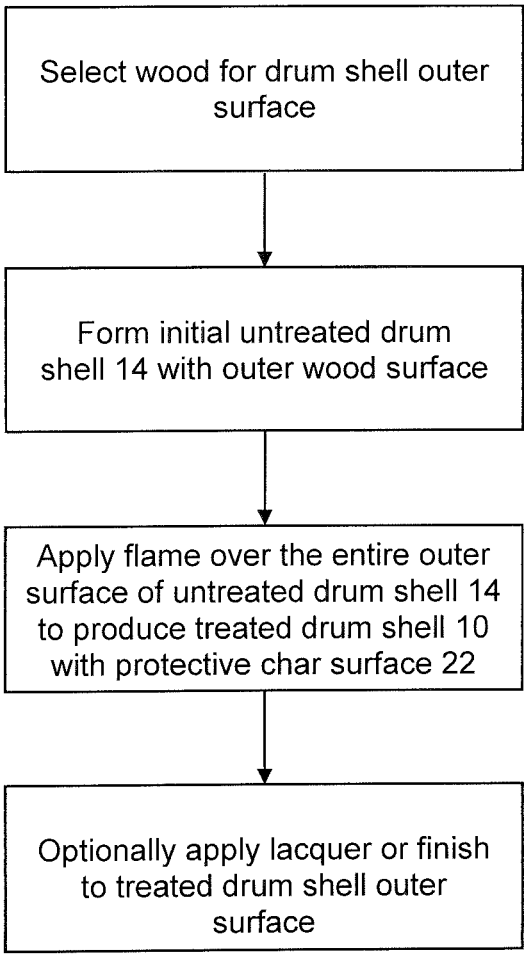
FIG. 5 is a flowchart depicting representative general steps of forming a flame-treated drum shell according to the disclosure.

With reference to FIG. 5, steps of a representative process for producing the flame-treated drum shell 10 are shown.

An exemplary preferred treated snare drum has the following elements and characteristics:

14"×6.5" maple shell with an outer ply layer of oak;

Chrome hardware, including 2.3 mm hoops, mini tube lugs, throw-off

B14UV1 batter head and S14H30 snare side head; and

Puresound Twisted series snare wires.

Prior to assembly of the exemplary snare drum, the oak ply layer was treated according to the disclosed direct flame-treatment process shown generally in flowchart of FIG. 5. The treated drum shell 10 formed by the direct flame-treatment process of FIG. 5 typically exhibits a "charred" or partially charred appearance on the armor surface 22.

As noted above, FIGS. 1-4 depict different flame source configurations appropriate for use in producing a flame-treated drum shell 10 in accordance with the disclosure. For example, FIG. 1 shows flame treatment directly applied via a ribbon burner system 18 where the flame is traversed back and forth over the axial length of the intermediate drum shell 12 while the shell is rotated. Alternatively, the intermediate drum shell 12 can be traversed through the burner flame, or a combination thereof, to produce a treated drum shell 10.

Figure 2:
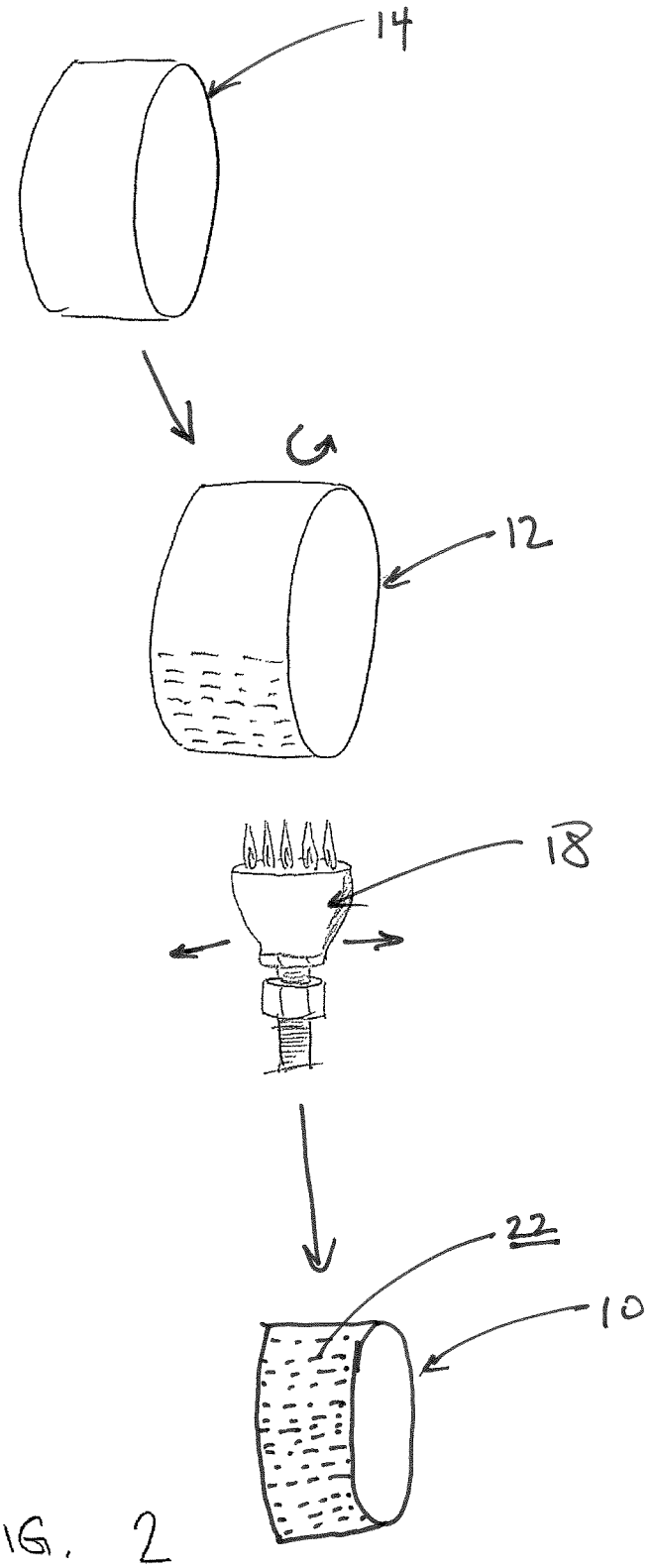
FIG. 2 shows another embodiment of a drum shell being flame-treated by a different type of flame source.

FIG. 2 depicts direct flame treatment via a single fishtail burner system 16 where the flame is traversed over the length of the intermediate drum shell 12, or the intermediate drum shell 12 is traversed through the burner flame, or a combination thereof, to produce a treated drum shell 10.

Figure 3:
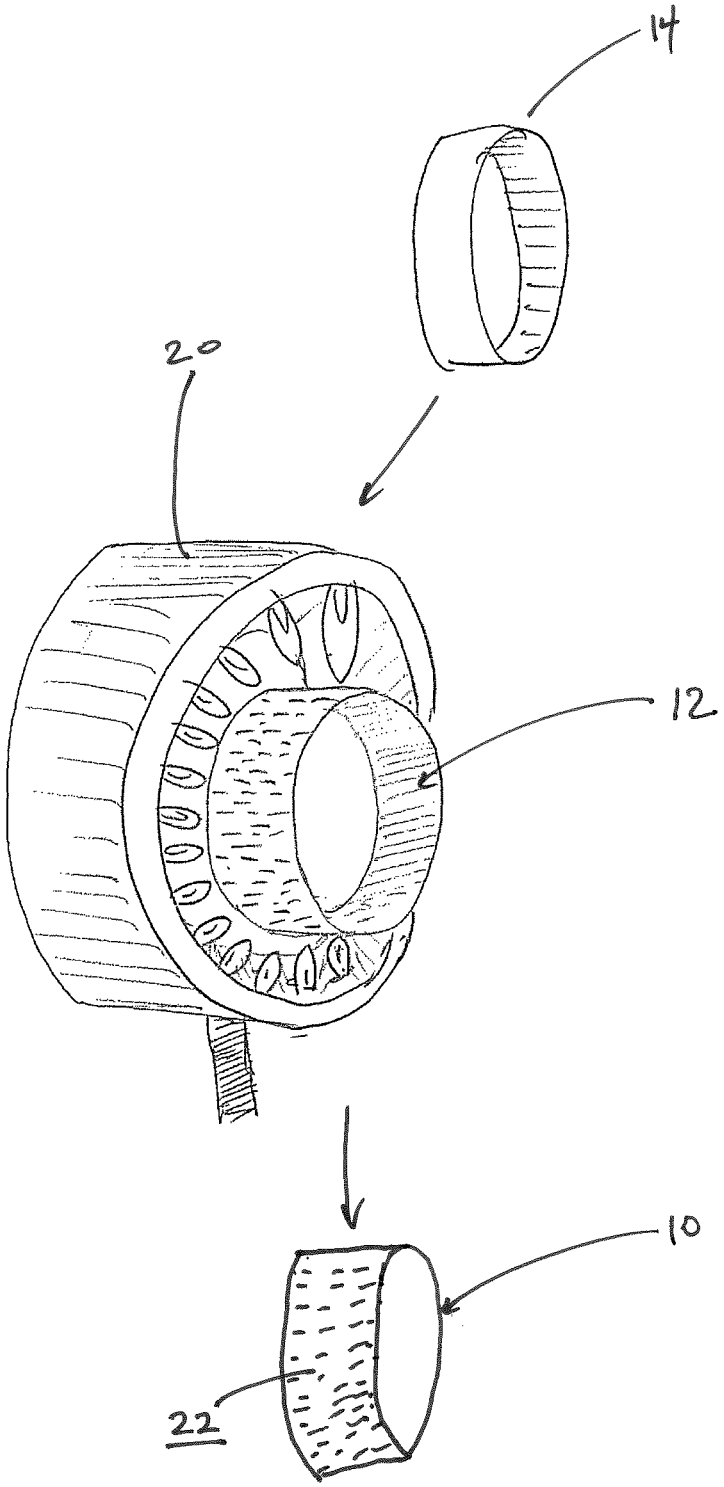
FIG. 3 shows another embodiment of a drum shell being flame-treated by yet another type of flame source.

FIG. 3 depicts an embodiment wherein direct flame treatment of an intermediate drum shell 12 via a multi-burner system 20 arranged into a ring or similar form where the flame is traversed over the length of the outer surface of drum shell 12 to produce the treated drum shell 10.

Figure 4:
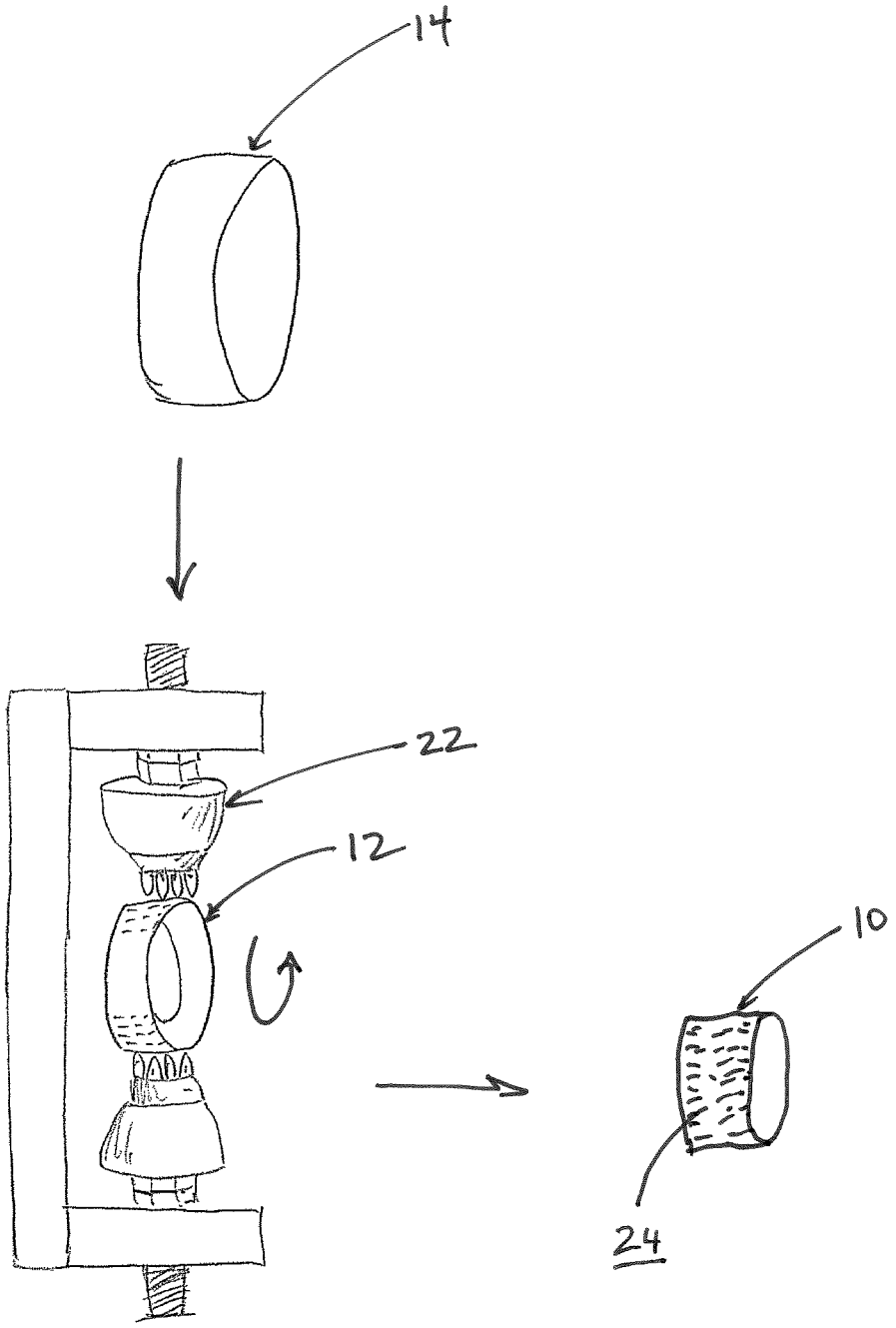
FIG. 4 shows another embodiment of a drum shell being flame-treated by yet another type of flame source.

FIG. 4 shows an embodiment wherein flame treatment is applied by a different multi-burner system 22 where the intermediate drum shell 12 is traversed through the burner flame to produce the treated drum shell 10.

While the above preferred example is for a drum shell with an outer surface made from oak, the process is similar for other woods typically used in forming drum shell surface, such as, for example, maple and hickory. The primary consideration is that the flame temperature for applying direct heat is high enough to alter the wood fiber at and near the outer surface (i.e., the outer layer) relative to untreated wood fibers and/or relative to inner fibers, but not so high so as to combust the wood being flame-treated. The alteration of the wood fibers may be via crystallization of residual tree sap resin found in the natural wood. This balance is generally found with an intensified flame at over 2000° F. contacting the outer wood surface, and more particularly over 3000° F., with careful monitoring of throughput. Embodiments of the flame treatment process utilize flames of up to about 4000° F. As noted above, the wood outer layer can optionally be pre-dried prior to the direct flame treatment.

Preferred process parameters for producing a flame-treated drum shell 10 from an untreated shell 14 of maple with an outer ply layer of oak as starting material include:

1) Fuel: propane (2-8) PSI and compressed air (18-20 PSI).

2) Flame temperature: 1400-2500° F., and more particularly between 1900-2100° F., and even more particularly 1900-2010° F.

3) Feed rate: 5-20 feet per minute, and more particularly approximately 10-20 feet per minute.

4) Post-flame-treatment coating: lacquered or other desired finish.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A method of manufacturing a treated wooden drum shell from an untreated drum shell starting material having a wooden exterior surface, comprising exposing the exterior surface of the untreated drum shell to a flame, thereby altering wood fibers in an outer layer of the treated drum shell relative to the untreated drum shell to form a protective armor layer.

2. The method of claim 1, wherein the untreated drum shell includes an exterior surface made from oak.

3. The method of claim 1, wherein the wood fibers are altered at least partially via crystallization of sap resin present in the wood on the exterior surface.

4. The method of claim 1, wherein the flame has a temperature of at least 1400 degrees Fahrenheit.

5. The method of claim 1, wherein the flame has a temperature within a range of approximately 1900 degrees Fahrenheit to approximately 2010 degrees Fahrenheit.

6. The method of claim 1, including the steps of (a) selecting a starting material made from wood;

(b) forming the starting material into an untreated drum shell with a wooden outer surface; and (c) treating the untreated drum shell by exposing the exterior surface to a flame having a temperature within the approximate range of 1400 degrees Fahrenheit to 2500 degrees Fahrenheit to produce the treated drum shell having a protective armor.

7. The method of claim 6, wherein the untreated drum shell defines a central axis extending in an axial direction, and step (c) of treating the untreated drum shell comprises exposing the exterior surface directly to a flame by reciprocating the untreated drum shell back and forth in the axial direction while rotating the untreated drum shell.

8. The method of claim 6, wherein the starting material has an exterior surface made from oak.

9. The method of claim 1, wherein the untreated drum shell starting material defines a central axis, and the step of exposing the exterior surface of the untreated drum shell to a flame is performed by reciprocating the untreated drum shell back and forth in the axial direction while rotating the untreated drum shell with the outer surface exposed directly to the flame.

10. The method of claim 1, wherein the untreated drum shell starting material defines a central axis extending in an axial direction, and exposing the exterior surface of the untreated drum shell to a flame is performed by rotating the drum shell while reciprocating a flame back and forth in the axial direction against the exterior surface.

11. A wooden drum shell with a flame-treated exterior surface, wherein wood fibers in an outer layer of the treated drum shell are altered relative to the wood fibers in the untreated drum shell via direct exposure to a flame.

12. The drum shell of claim 11, wherein the entire exterior surface is flame-treated.

13. The drum shell of claim 11, wherein the wooden drum shell is formed of a first wood material and the drum shell has altered hardness properties relative to an untreated drum shell of the first wood material.

14. A method of manufacturing a treated wooden drum shell from a wooden starting material, comprising the steps of:

(a) selecting a wooden starting material;

(b) forming an outer surface of a drum shell with the wooden starting material to produce an untreated drum shell having an outer surface; and (c) treating the untreated drum shell by exposing the outer surface to a flame having a temperature within the approximate range of 1400 degrees Fahrenheit to 2500 degrees Fahrenheit to produce the treated drum shell, wherein the flame exposure alters wood fibers in an outer layer of the treated drum shell relative to the wood fibers in the outer surface of the untreated drum shell.

15. The method of claim 14, wherein the alteration of the wooden fibers is caused at least partially from crystallization of sap resin present in the outer layer.

16. The method of claim 14, wherein the wooden starting material is selected from the group consisting of hickory, maple and oak.

17. The method of claim 14, wherein the alteration of wood fibers in the outer layer results in a treated drum shell with a different hardness compared to the untreated drum shell.

18. The method of claim 14, wherein the outer surface of the untreated drum shell defines a central axis extending in an axial direction, and step (c) of treating untreated drum shell is performed by exposing the outer surface of the untreated drum shell directly to a flame by reciprocating the untreated drum shell back and forth in the axial direction while rotating the untreated drum shell.

19. The method of claim 14, wherein the outer surface of the untreated drum shell defines a central axis extending in an axial direction, and exposing the outer surface of the untreated drum shell to a flame is performed by rotating the untreated drum shell while reciprocating a flame back and forth in the axial direction against the outer surface.

20. The method of claim 14, wherein the flame has a temperature within the range of approximately 1900 degrees Fahrenheit to approximately 2010 degrees Fahrenheit.

* * * * *